US009254947B2

(12) United States Patent
Tada et al.

(10) Patent No.: US 9,254,947 B2
(45) Date of Patent: Feb. 9, 2016

(54) SAFETY CAP

(71) Applicant: SHINKO CHEMICAL CO., LTD., Ishikawa (JP)

(72) Inventors: Kaori Tada, Ishikawa (JP); Osamu Takahata, Ishikawa (JP)

(73) Assignee: SHINKO CHEMICAL CO., LTD., Ishikawa (JP)

( * ) Notice: Subject to any disclaimer, the term of this patent is extended or adjusted under 35 U.S.C. 154(b) by 0 days.

(21) Appl. No.: 14/405,603

(22) PCT Filed: Nov. 21, 2012

(86) PCT No.: PCT/JP2012/080187

§ 371 (c)(1),
(2) Date: Dec. 4, 2014

(87) PCT Pub. No.: WO2013/183180

PCT Pub. Date: Dec. 12, 2013

(65) Prior Publication Data

US 2015/0175324 A1 Jun. 25, 2015

(30) Foreign Application Priority Data

Jun. 7, 2012 (JP) ..... 2012-129510

(51) Int. Cl.
*B65D 55/02* (2006.01)
*B65D 50/04* (2006.01)

(52) U.S. Cl.
CPC ..... *B65D 50/041* (2013.01); *B65D 2215/02* (2013.01)

(58) Field of Classification Search
USPC ..... 215/332, 220, 252, 217, 218, 219, 201, 215/221; 220/288, 254.8
See application file for complete search history.

(56) References Cited

U.S. PATENT DOCUMENTS 3,857,505 A 12/1974 Mumford et al.
4,624,377 A 11/1986 Wassilieff
(Continued)

FOREIGN PATENT DOCUMENTS

JP 50-60387 5/1975
JP 60-45158 3/1985
(Continued)

OTHER PUBLICATIONS

International Search Report issued Mar. 5, 2013 in International Application No. PCT/JP2012/080187.
(Continued)

*Primary Examiner* — Anthony Stashick
*Assistant Examiner* — Raven Collins
(74) *Attorney, Agent, or Firm* — Wenderoth, Lind & Ponack, L.L.P.

(57) ABSTRACT

A safety cap including a screw-type inner cap detachably mounted on a container mouth; and an outer cap that is combined with the inner cap so as to be rotatable relative to the inner cap. Each of the inner cap and the outer cap has a plurality of engaging protuberances. The engaging protuberances of the inner cap and the engaging protuberances of the outer cap are engaged with each other and rotate the inner cap when the outer cap is rotated while being pressed toward the inner cap. Each of the engaging protuberances has a vertical part that is engaged when the outer cap is rotated in a closing direction and an inclined part that is engaged when the outer cap is rotated in an opening direction. The inclined part has a steeply inclined part and a gently inclined part that is continuous with the steeply inclined part.

2 Claims, 8 Drawing Sheets

(A)

(56) References Cited

U.S. PATENT DOCUMENTS

| | | | | |
|---|---|---|---|---|
| 6,015,054 | A * | 1/2000 | King et al. | 215/252 |
| 7,571,825 | B2 | 8/2009 | Takahashi | |
| 7,988,003 | B1 * | 8/2011 | Clodfelter | B65D 50/041 215/220 |
| 8,157,115 | B2 | 4/2012 | Rho | |
| 2006/0219651 | A1 | 10/2006 | Takahashi | |
| 2008/0164234 | A1 | 7/2008 | Rho | |
| 2009/0250425 | A1 | 10/2009 | Yoshihiro et al. | |
| 2013/0015157 | A1 | 1/2013 | Rho | |

FOREIGN PATENT DOCUMENTS

| | | |
|---|---|---|
| JP | 2-124846 | 10/1990 |
| JP | 2000-185748 | 7/2000 |
| JP | 2004-331189 | 11/2004 |
| JP | 4844807 | 12/2011 |
| JP | 2012-71896 | 4/2012 |

OTHER PUBLICATIONS

Office Action issued Aug. 24, 2015 in corresponding Chinese patent application No. 201280073763.8 (with English translation).

* cited by examiner (A)

(B)

(B)

(A)

(B)

(A)

SAFETY CAP

BACKGROUND OF THE INVENTION

1. Technical Field

The present invention relates to a safety cap with a child-resistant function which has a devised cap structure that makes it difficult for infants etc. to carelessly open the cap.

2. Description of the Related Art

There is known a safety cap with a child-resistant function which includes an inner cap with a female screw to be mounted on a mouth of a container, an outer cap that is movable in an axial direction relative to the inner cap, and which incorporates a ratchet mechanism between the inner cap and the outer cap (see, for example, JP 4844807 B1).

The safety cap of JP 4844807 has a plurality of upward ratchet teeth formed on an outer circumference of an upper part of the inner cap and a plurality of downward ratchet pawls formed on a ceiling surface of the outer cap. The ratchet pawls on the outer cap side have a simple flat plate shape. The ratchet teeth on the inner cap side are formed such that their surfaces that make contact with the ratchet pawls on the outer cap side when the safety cap is rotated in a direction in which the safety cap is tightened on the container are perpendicular to main surfaces of the ratchet pawls and such that their surfaces that make contact with the ratchet pawls on the outer cap side when the safety cap is rotated in a direction in which the safety cap is taken off from the container are inclined.

When the outer cap is rotated in the direction in which the safety cap is tightened on the container, the ratchet pawls having a flat plate shape are engaged with the perpendicular surfaces of the ratchet teeth so as to rotate the inner cap together. This allows the female screw of the inner cap to be tightened on a male screw of the container. Meanwhile, when the outer cap is just rotated in the direction in which the safety cap is taken off from the container, the outer cap just spins as the ratchet pawls slip on the inclined surfaces of the ratchet teeth. It is therefore possible to prevent the safety cap from being carelessly taken off. It is necessary to rotate the outer cap while pressing down the outer cap in order to take off the safety cap from the container. JP 4844807 describes that infants are incapable of executing such an operation correctly, and therefore a child-resistant function can be realized (paragraph 0004).

SUMMARY OF THE INVENTION

1. Problems to be Solved by the Invention

The conventional safety cap of JP 4844807 has the following problem. Specifically, a corner of each of the ratchet pawls having a flat plate shape is engaged with one point of an inclined surface of a corresponding ratchet tooth. Accordingly, when a pressing force is accidentally applied to the outer cap, there are cases where a surprisingly large rotational force in an opening direction is applied to the inner cap. In this case, there is a risk of mistakenly opening the cap.

The present invention was developed in view of the above problems of the conventional safety cap, and an object of the present invention is to provide a safety cap whereby a child-resistant function can be improved.

2. Solutions to the Problems

The configuration of the present invention is a safety cap comprising: a screw-type inner cap detachably mounted on a mouth of a container; and an outer cap that is combined with the inner cap so as to be rotatable relative to the inner cap, each of the inner cap and the outer cap having a plurality of engaging protuberances, the engaging protuberances of the inner cap and the engaging protuberances of the outer cap being engaged with each other and rotating the inner cap when the outer cap is rotated while being pressed toward the inner cap, each of the engaging protuberances having a vertical part that is engaged when the outer cap is rotated in a closing direction and an inclined part that is engaged when the outer cap is rotated in an opening direction, and the inclined part having a steeply inclined part that has a steep inclination and a gently inclined part that has a gentler inclination than the steeply inclined part, the steeply inclined part and the gently inclined part being continuous with each other.

The inclined part has a convex inclined part that is formed into a convex shape by the steeply inclined part and the gently inclined part in one of the engaging protuberance of the inner cap and the engaging protuberance of the outer cap and a concave inclined part that is formed into a concave shape by the steeply inclined part and the gently inclined part in the other of the engaging protuberance of the inner cap and the engaging protuberance of the outer cap; and the convex inclined part and the concave inclined part may be engageable in close contact with each other. It is preferable that the steeply inclined part has a longer length in a circumferential direction than the gently inclined part.

3. Effect of the Invention

According to a safety cap of the present invention, engaging protuberances of an inner cap and engaging protuberances of an outer cap are engaged with each other via their vertical parts when the outer cap is rotated in a closing direction. Meanwhile, when the outer cap is rotated in an opening direction, the engaging protuberances of the inner cap and the engaging protuberances of the outer cap are engaged with each other via their inclined parts. This forms a ratchet mechanism that rotates the inner cap in the opening direction. Here, when the outer cap is rotated in the opening direction, the inclined parts of the engaging protuberances slip, and the outer cap receives a force in a direction away from the inner cap and tends to float up from the inner cap. When the outer cap floats up even a little, the gently inclined parts are separated away from each other at once. This extremely reduces a contact area between the inclined parts that are engaged with each other, thereby reducing frictional resistance. Accordingly, the outer cap more easily floats up and it is possible to significantly lower the risk of rotating the inner cap in the opening direction. That is, even in a case where tightening torque at closing is small, the inner cap is not rotated in the opening direction in such a case that an infant etc. rotates the outer cap in the opening direction. It is therefore possible to improve the child-resistant function.

Furthermore, according to the safety cap, an inclination of a steeply inclined part and an inclination of a gently inclined part of each of the engaging protuberances of the inner cap are set to the same as an inclination of a steeply inclined part and an inclination of a gently inclined part of each of the engaging protuberances of the outer cap, and a convex inclined part formed into a convex shape on one of the engaging protuberances and a concave inclined part formed into a concave shape on the other of the engaging protuberances can be engaged in close contact with each other.

Furthermore, in the safety cap, the steeply inclined part has a longer length in a circumferential direction than the gently inclined part. This makes it possible to obtain a sufficient rotational force in a direction in which the inner cap is opened at opening.

DETAILED DESCRIPTION OF THE INVENTION

Figure 1:
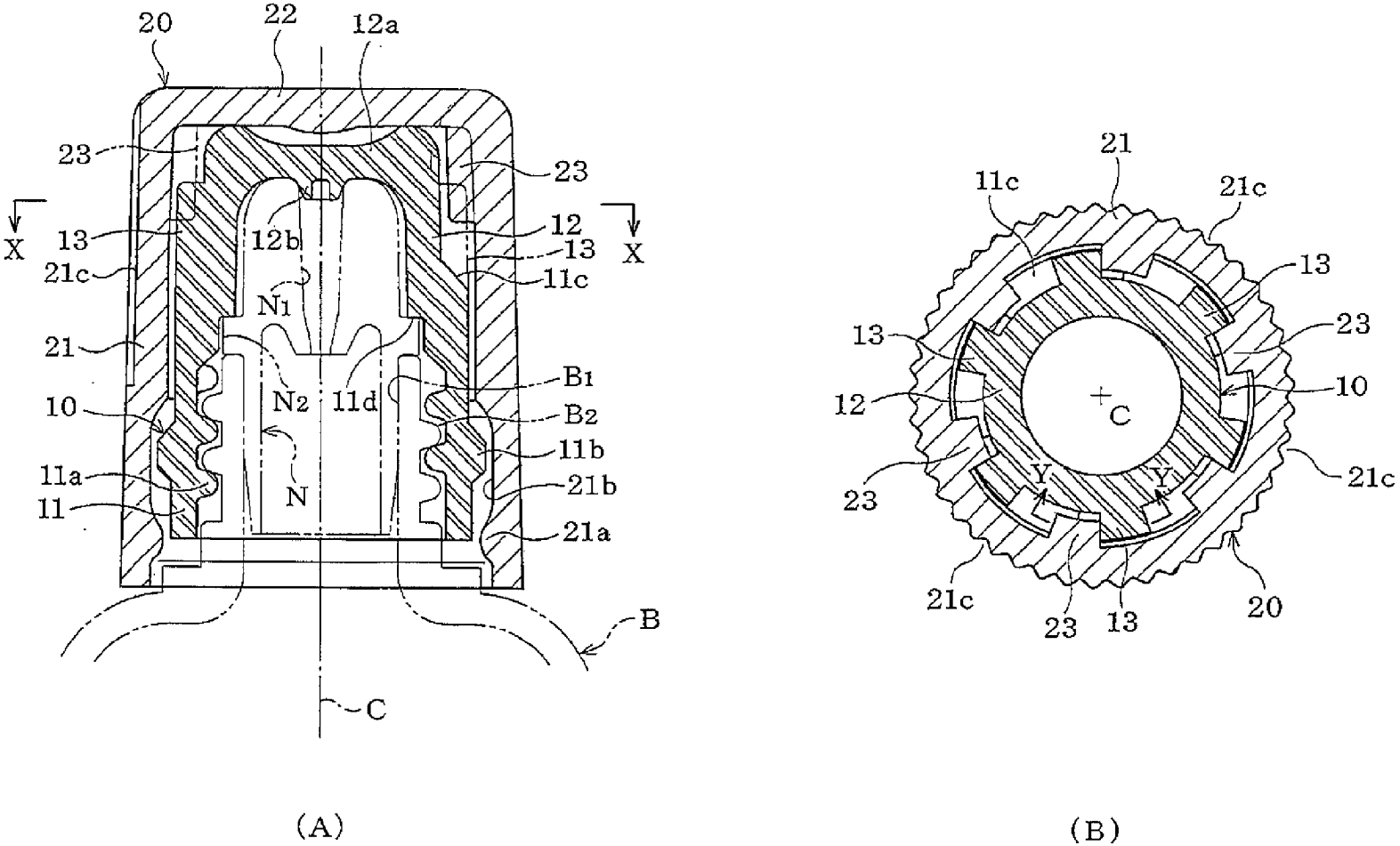
FIG. 1(A) is a longitudinal cross-sectional view of a safety cap according to an embodiment of the present invention.
FIG. 1(B) is a cross-sectional view of the safety cap taken along line X-X of FIG. 1(A).
Figure 2:
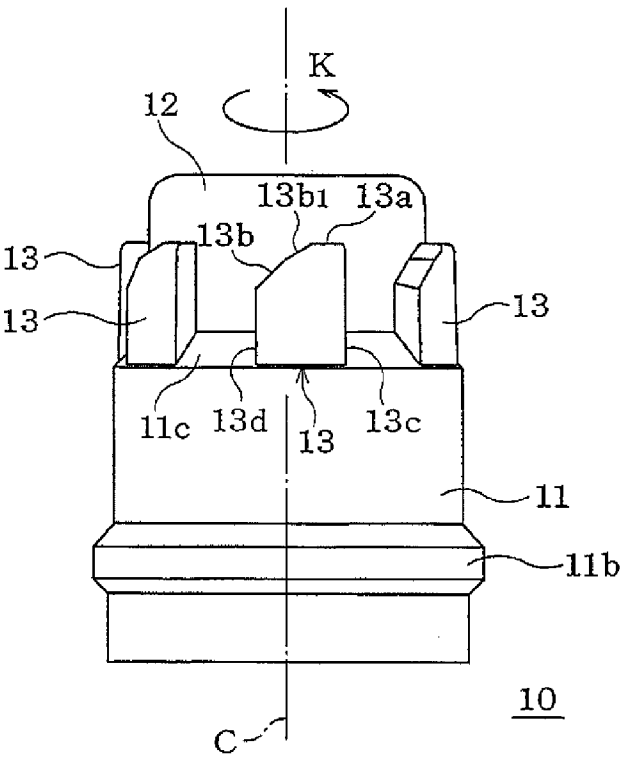
FIG. 2(A) is a front view of the inner cap 10.
FIG. 2(B) is a top view of the inner cap 10.
Figure 2:
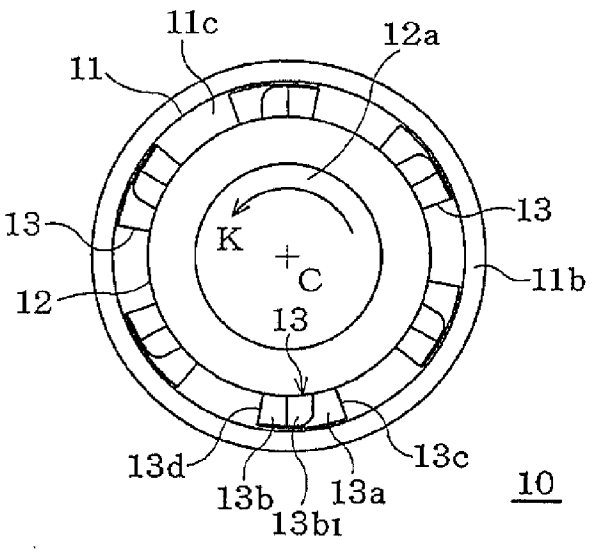

An embodiment of the present invention is described below with reference to the drawings.

A safety cap includes a screw-type inner cap 10 that is detachably mounted on a mouth of a container, and an outer cap 20 that is combined with the inner cap 10 so as to be rotatable relative to the inner cap 10 (see FIGS. 1(A) and 1(B)). FIG. 1(A) is a longitudinal cross-sectional view of the safety cap, taken along a central axis C (the one-dot chain line in FIG. 1(A)) common to the inner cap 10 and the outer cap 20. FIG. 1(B) is a cross-sectional view of the safety cap taken along line X-X of FIG. 1(A). It should be noted that the left half of FIG. 1(A) is a cross-sectional view, taken along a position corresponding to an engaging protuberant part 13 of the inner cap 10 in FIG. 1(B), and the right half of FIG. 1(A) is a cross-sectional view, taken along a position corresponding to an engaging protuberant part 23 of the outer cap 20 in FIG. 1(B).

As illustrated in FIG. 1(A), the safety cap is used by being mounted detachably on a mouth B1 of a container B that is virtually illustrated (the two-dot chain line in FIG. 1(A)). A male screw B2 is formed on an outer circumference of the mouth B1 of the container B. A nozzle N having a nozzle hole N1 on the central axis C is pressed into the mouth B1.

The inner cap 10 has a skirt part 11 that forms a lower part of the inner cap 10, a small-diameter part 12 that forms an upper part of the inner cap 10, and a ceiling part 12*a* that closes an upper end of the small-diameter part 12, and the inner cap 10 is formed into a cylindrical shape having a step (an oblique step 11*c*) (see FIGS. 1(A), 1(B), 2(A) and 2(B)).

FIG. 2(A) is a front view of the inner cap 10, and FIG. 2(B) is a top view of the inner cap 10.

As illustrated in FIG. 1(A), a female screw 11*a* that is fitted to the male screw B2 on the container B side is formed on an inner surface of the skirt part 11. An annular rib 11*b* is formed on a lower part of an outer circumference of the skirt part 11. An upper end of the skirt part 11 is continuous with the small-diameter part 12 via the oblique step 11*c*. A step 11*d* that is engaged with an outer flange N2 formed on the middle of the nozzle N is formed on an inner side of the oblique step 11*c*. The engagement of the step 11*d* with the outer flange N2 defines a tightening limit at closing.

As illustrated in FIG. 1(A), a downward stopper 12*b* that closes the nozzle hole N1 of the nozzle N is formed on a central part of an inner surface of the ceiling part 12*a* of the small-diameter part 12. A central part of an upper surface of the ceiling part 12*a* is smoothly recessed.

As illustrated in FIGS. 1(A) and 2(A), a plurality of engaging protuberant parts 13 that protrude upward are formed on the oblique step 11*c* at regular intervals in a circumferential direction. Each of the engaging protuberant parts 13 has a thickness that is almost equal to the width of the oblique step 11*c* and each of the engaging protuberant parts 13 is integrated with an outer circumferential surface of the small-diameter part 12 so that strength is increased. An upper end surface of each of the engaging protuberant parts 13 has a horizontal part 13*a*, a gently inclined part 13*b*1, and a steeply inclined part 13*b* that are formed in this order from the forward side toward the backward side of an opening direction of the inner cap 10 (the direction indicated by arrow K in FIGS. 2(A) and 2(B)). Front and rear side surfaces of each engaging protuberant part 13 are a vertical part 13*c* and a vertical part 13*d*, respectively. The horizontal part 13*a* is a surface that is perpendicular to the central axis C. The steeply inclined part 13*b* and the gently inclined part 13*b*1 are different in the degree of inclination. The steeply inclined part 13*b*, which has a steeper inclination than the gently inclined part 13*b*1, and the gently inclined part 13*b*1, which has a gentler inclination than the steeply inclined part 13*b*, are continuous with each other so as to form an inclined part. The vertical part 13*c* and the vertical part 13*d* are surfaces that are perpendicular to the horizontal part 13*a*.

Figure 3:
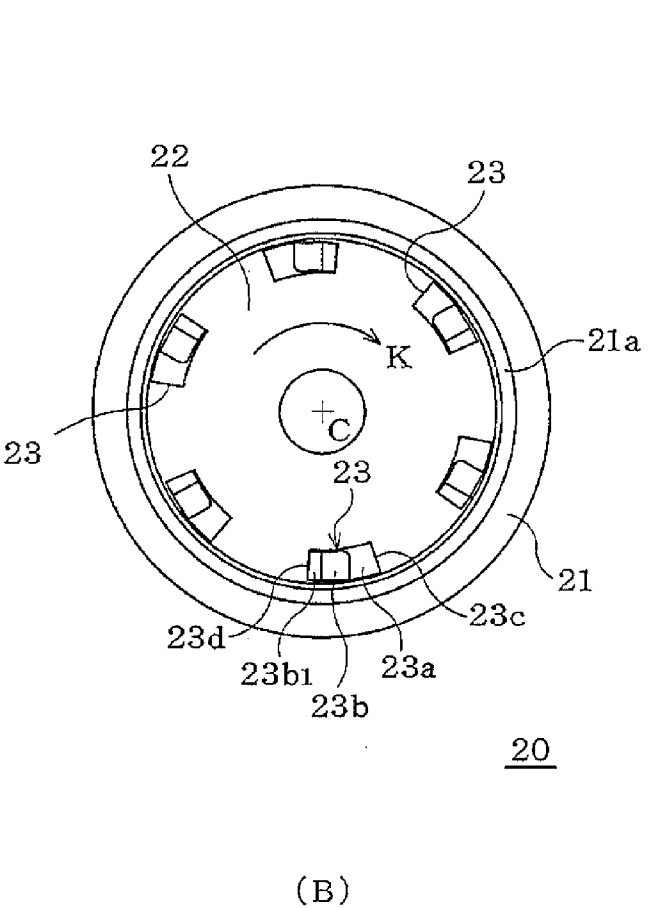
FIG. 3(A) is a longitudinal cross-sectional view of the outer cap.
FIG. 3(B) is a bottom view of the outer cap.
Figure 3:
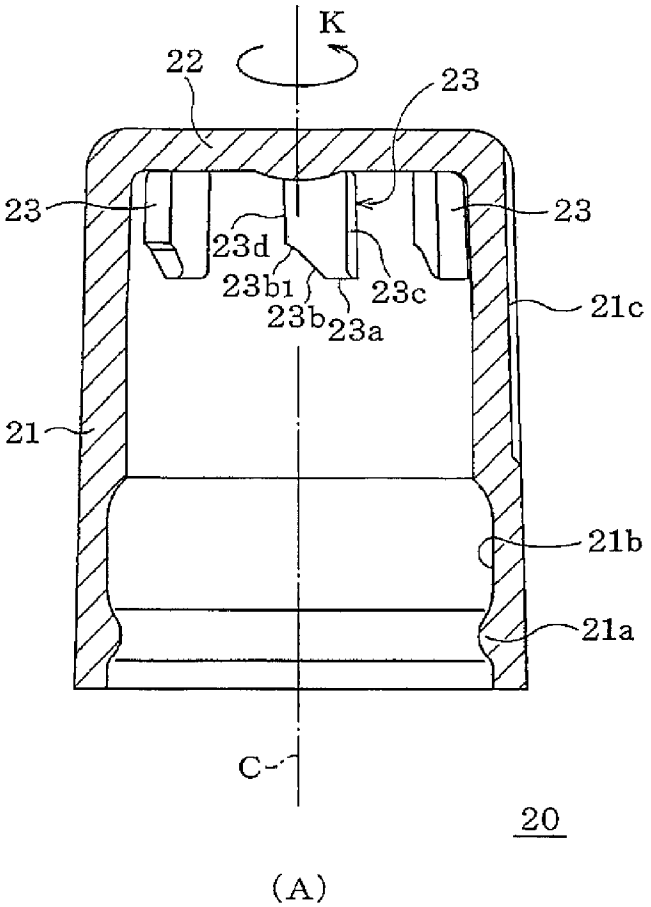

The outer cap 20 has a skirt part 21 that has a tapered shape slightly reducing the diameter from the bottom side to the top side, a ceiling part 22 that closes an upper end of the skirt part 21, and a plurality of engaging protuberant parts 23 that are suspended from a lower surface of the ceiling part 22 (see FIGS. 1(A), 1(B), 3(A), and 3(B)). FIG. 3(A) is a longitudinal cross-sectional view, taken along the central axis C (the one-dot chain line in FIG. 3(A)) of the outer cap 20. FIG. 3(B) is a bottom view of the outer cap 20.

As illustrated in FIGS. 1(A) and 3(A), an annular rib 21*a* is formed on a lower end part of an inner circumferential surface of the skirt part 21. A wide annular recess 21*b*, in which the annular rib 11*b* of the inner cap 10 is contained so as to be movable upward and downward, is formed above the annular rib 21*a*. A plurality of anti-slip knurlings 21*c* are formed over the whole circumference of an outer circumferential surface of an upper part of the skirt part 21.

A plurality of engaging protuberant parts 23 that protrude downward are formed on an inner surface of the upper part of the skirt part 21 at regular intervals in the circumferential direction. Each of the engaging protuberant parts 23 is formed into a vertically-long curved block shape so as to be integral with the inner surface of the skirt part 21 and the inner surface of the ceiling part 22. A lower end surface of each of the engaging protuberant parts 23 has a gently inclined part 23*b*1, a steeply inclined part 23*b*, and a horizontal part 23*a* that are formed in this order from the forward side to the backward side of an opening direction of the outer cap 20 (the direction indicated by arrow K in FIGS. 3(A) and 3(B)). Front and rear side surfaces of each of the engaging protuberant parts 23 are a vertical part 23*d* and a vertical part 23*c*, respectively. The gently inclined part 23*b*1, which is gently inclined, and the steeply inclined part 23*b*, which has a steeper inclination than the gently inclined part 23*b*1, are continuous with each other so as to form an inclined part. The horizontal part 23*a* is a surface that is perpendicular to the central axis C. The vertical part 23*d* and the vertical part 23*c* are surfaces that are perpendicular to the horizontal part 23*a*.

Figure 4:
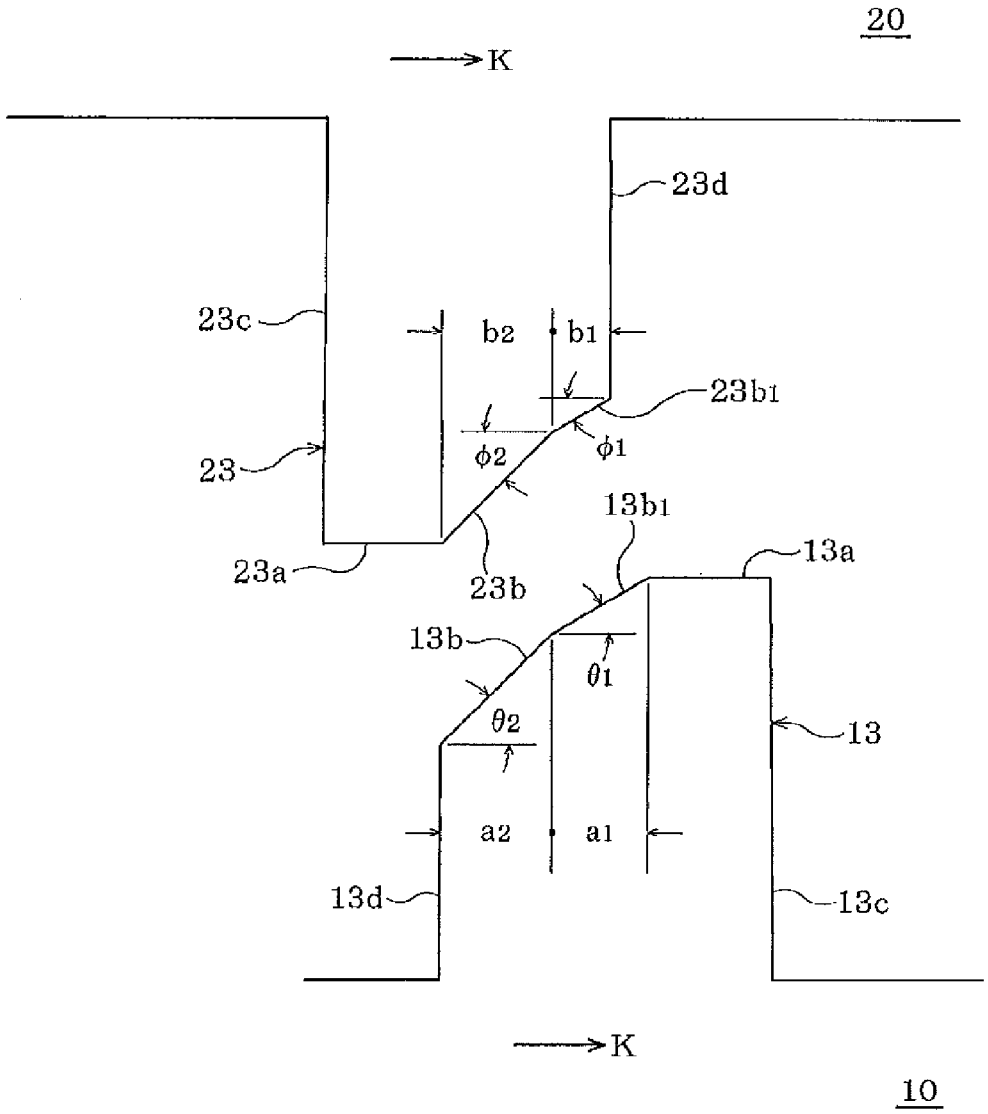
FIG. 4 is an enlarged view taken along line Y-Y of FIG. 1(B).

The engaging protuberant parts 13 on the inner cap 10 side and the engaging protuberant parts 23 on the outer cap 20 side correspond to each other, up and down (see FIGS. 1(A), 1(B), and 4). Meanwhile, the outer cap 20 is movable in the axial direction relative to the inner cap 10. When the outer cap 20 is pressed down to its descending limit toward the inner cap 10, each pair of upper parts of the engaging protuberant parts 13 and lower parts of the engaging protuberant parts 23 are engaged with each other (see FIG. 1(A)). When the outer cap 20 is at an ascending limit, each pair of engaging protuberant part 13 and engaging protuberant part 23 are separated from each other in a top-bottom direction and are not engaged (see FIG. 4). The descending limit of the outer cap 20 is regulated by contact of the inner surface of the ceiling part 22 of the outer cap 20 with the upper end of the inner cap 10 (see FIG. 1(A)). Meanwhile, the ascending limit of the outer cap 20 is regulated by contact of the annular rib 21*a* formed on the lower end part of the inner circumference of the outer cap 20 with a lower part of the annular rib 11*b* formed on the outer circumference of the inner cap 10. Accordingly, the outer cap 20 is undetachably combined with the inner cap 10.

Assume that an inclination of the gently inclined part 13*b*1 formed on the upper end surface of the engaging protuberant part 13 of the inner cap 10 with respect to a horizontal plane is $\theta 1$, the length of the gently inclined part 13*b*1 in the circumferential direction is a1, an inclination of the steeply inclined part 13*b* formed on the upper end surface of the engaging protuberant part 13 of the inner cap 10 with respect to a horizontal plane is $\theta 2$, and the length of the steeply inclined part 13*b* in the circumferential direction is a2, as illustrated in FIG. 4. Assume that an inclination of the gently inclined part 23*b*1 formed on the lower end surface of the engaging protuberant part 23 of the outer cap 20 with respect to a horizontal plane is $\phi 1$, the length of the gently inclined part 23*b*1 in the circumferential direction is b1, an inclination of the steeply inclined part 23*b* formed on the lower end surface of the engaging protuberant part 23 of the outer cap 20 with respect to a horizontal plane is $\phi 2$, and the length of the steeply inclined part 23*b* is b2. It is assumed here that $\theta 1=\phi 1\approx 30°$, $\theta 2=\phi 2\approx 45°$, $a1\geq b1$, $a2\geq b2$, $a2/a1=1$ to 4, and $b2/b1=1$ to 4. In this way, the steeply inclined part 13*b* and the gently inclined part 13*b*1 of the engaging protuberant part 13 are formed into a convex shape (hereinafter referred to as "convex inclined part") as a whole, and the steeply inclined part 13*b* has a longer length in the circumferential direction than the gently inclined part 13*b*1. The steeply inclined part 23*b* and the gently inclined part 23*b*1 of the engaging protuberant part 23 are formed into a concave shape (hereinafter referred to as "concave inclined part") as a whole, and the steeply inclined part 23*b* has a longer length in the circumferential direction than the gently inclined part 23*b*1. The convex inclined part and the concave inclined part are engageable in close contact with each other. Although, in the present embodiment, the steeply inclined part 13*b* and the gently inclined part 13*b*1 of the engaging protuberant part 13 form the convex inclined part, and the steeply inclined part 23*b* and the gently inclined part 23*b*1 of the engaging protuberant part 23 form the concave inclined part, the shape of the steeply inclined part 13*b* and the gently inclined part 13*b*1 and the shape of the steeply inclined part 23*b* and the gently inclined part 23*b*1 may be exchanged with each other. That is, it is only necessary that one of the engaging protuberant part 13 and the engaging protuberant part 23 be a convex inclined part and the other one of the engaging protuberant part 13 and the engaging protuberant part 23 be a concave inclined part.

In this safety cap, when the outer cap 20 is rotated in a closing direction (the direction opposite to the direction indicated by arrow K in FIG. 4) while being pressed down in the axial direction, the vertical part 23*c* of each of the engaging protuberant part 23 that is on the forward side in the closing direction is engaged with the vertical part 13*c* of each of the engaging protuberant parts 13 on the inner cap 10 side that is on the backward side in the closing direction and this rotates the inner cap 10 in the closing direction. In this way, it is possible to surely close the mouth B1 of the container B.

Figure 5:
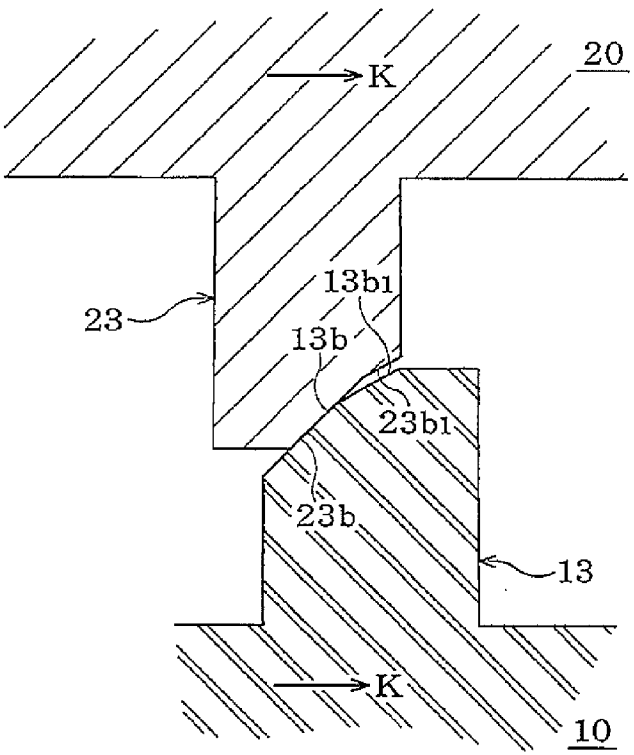
FIGS. 5(A) and (B) are operation explaining views taken along line Y-Y of FIG. 1(B).
Figure 5:
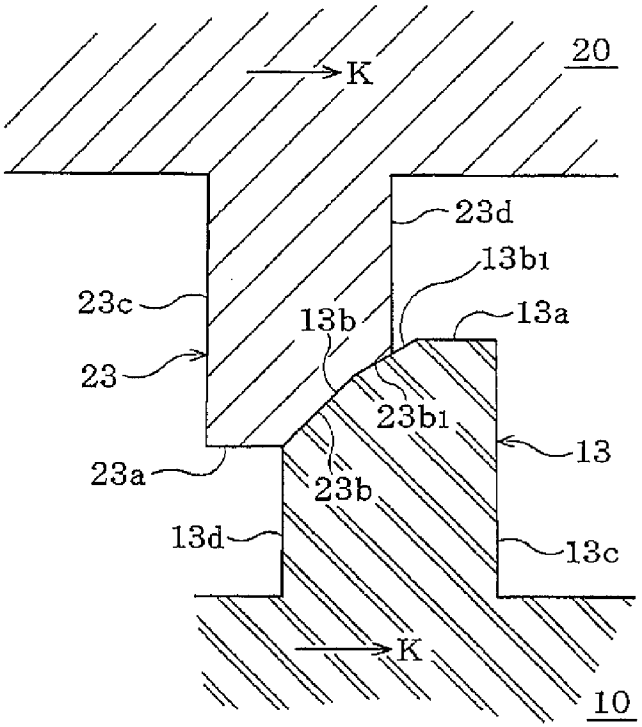

Meanwhile, when the mouth B1 of the container B is opened, the outer cap 20 is rotated in the opening direction (the direction indicated by arrow K in FIG. 4) while being pressed in the axial direction. In this case, the engaging protuberant parts 23 on the outer cap 20 side are engaged with the corresponding engaging protuberant parts 13 on the inner cap 10 side so that the steeply inclined part 23*b* and the gently inclined part 23*b*1 are in close contact with the steeply inclined part 13*b* and the gently inclined part 13*b*1, respectively (see FIG. 5(A)). This transmits a rotational force in the opening direction to the inner cap 10, thereby rotating the inner cap 10 to be able to open the mouth B1. If the pressing force in the axial direction applied to the outer cap 20 is small, the steeply inclined part 23*b* on the outer cap 20 side slips on the steeply inclined part 13*b* on the inner cap 10 side, and as a result, the outer cap 20 floats up (see FIG. 5(B)). This significantly reduces the contact area between the engaging protuberant parts 23 and the engaging protuberant parts 13. As a result, the outer cap 20 more easily floats up to reduce frictional resistance between the engaging protuberant parts 23 and the engaging protuberant parts 13, and the rotational force for rotating the inner cap 10 in the opening direction is also significantly decreased. Consequently, it is possible to minimize a risk of mistakenly opening the mouth B1 of the container B.

(Modification)

Figure 6:
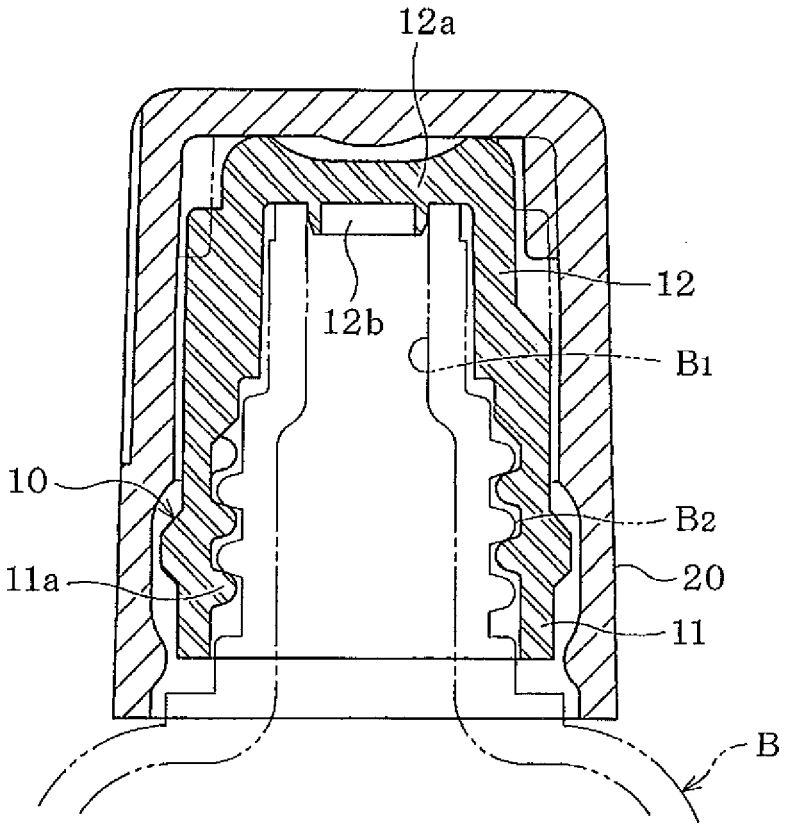
FIG. 6 is a view that corresponds to FIG. 1(A) showing another embodiment.

The container B of FIG. 1 may have a wide mouth B1 in which the nozzle N is not used (see FIG. 6). In this case, a tightening limit at capping is defined by closing the mouth B1 by a stopper 12*b* that has a short skirt shape and is suspended from a lower surface of a ceiling part 12*a* of an inner cap 10, and contact of an upper end of the mouth B1 with the lower surface of the ceiling part 12*a*.

Figure 7:
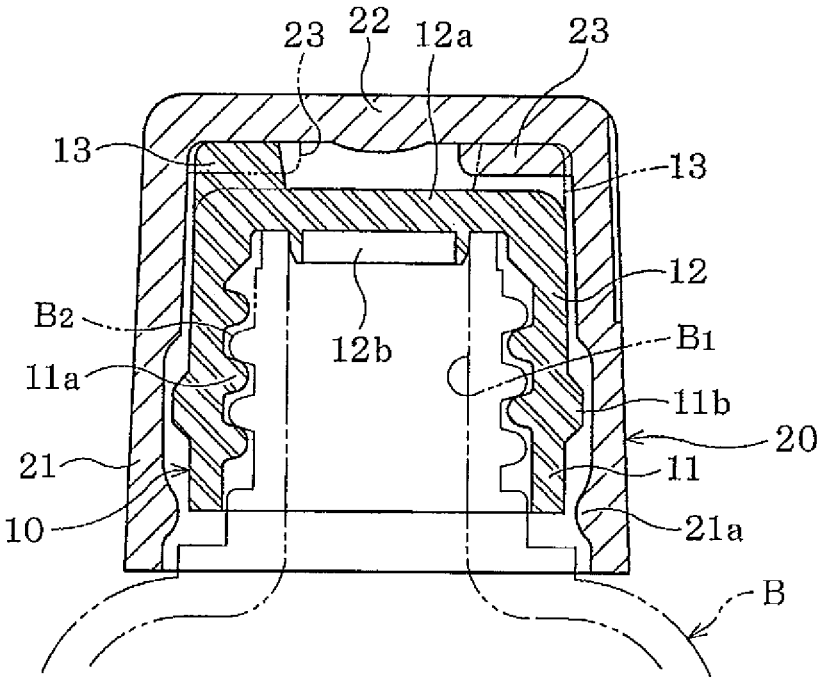
FIG. 7 is a view that corresponds to FIG. 1(A) showing yet another embodiment.
Figure 8:
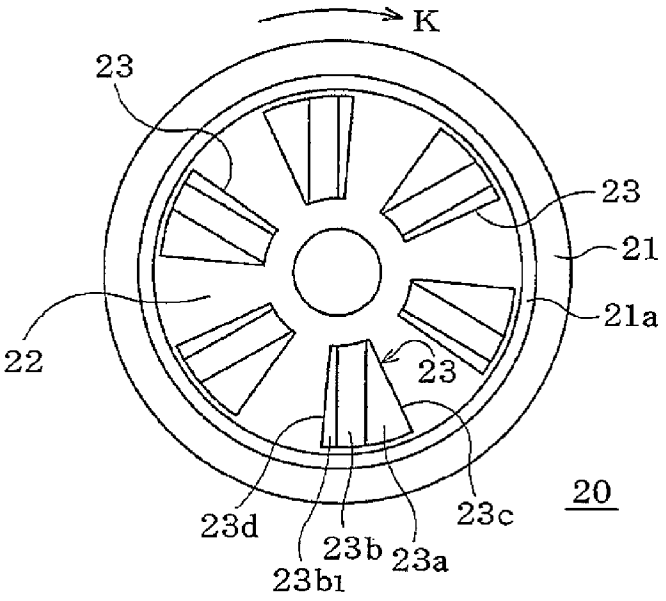
FIG. 8(A) is a top view of the inner cap.
FIG. 8(B) is a bottom view of the outer cap.
Figure 8:
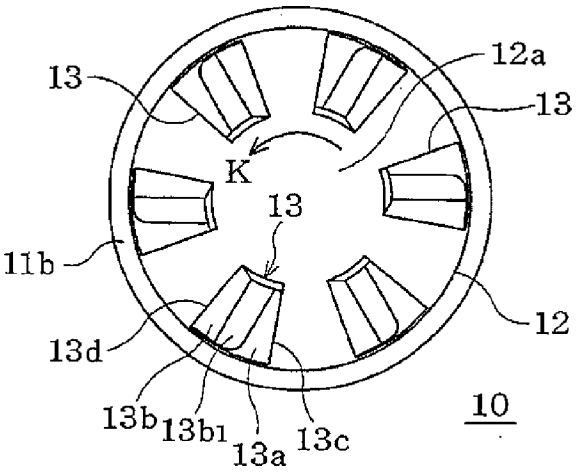

The inner cap 10 may be formed without the oblique step 11*c* in the middle part of the outer circumference of the inner cap 10, so that the skirt part 11 that forms a lower half of the inner cap 10 and the small-diameter part 12 that forms an upper half of the inner cap 10 have an identical diameter (see FIGS. 7, 8(A), and 8(B)). FIG. 8(A) is a top view of the inner cap 10, and FIG. 8(B) is a bottom view of the outer cap 20.

In FIGS. 7, 8(A), and 8(B), engaging protuberant parts 13, 13 . . . on the inner cap 10 side are provided at regular intervals in a circular form along a peripheral part of the upper surface of the ceiling part 12*a* of the inner cap 10, and engaging protuberant parts 13, 13 . . . are formed into a fan-like flat block that is longer in the radial direction of the inner cap 10. A horizontal part 13*a*, a gently inclined part 13*b*1, and a steeply inclined part 13*b* are formed on an upper surface of each of the engaging protuberant parts 13 in this order from the forward side to the backward side of an opening direction of the inner cap 10 (die direction indicated by arrow K in FIG. 8(A)). Front and rear side surfaces of each of the engaging protuberant parts 13 are a vertical part 13*c* and a vertical part 13*d*, respectively.

Meanwhile, engaging protuberant parts 23, 23 . . . on the outer cap 20 side are provided at regular intervals in a circular form along a peripheral part of the lower surface of the ceiling part 22 of the outer cap 20, and engaging protuberant parts 23, 23 . . . are formed into a fan-like flat block that is longer in the radial direction of the outer cap 20. A gently inclined part 23*b*1, a steeply inclined part 23*b*, and a horizontal part 23*a* are formed on a lower surface of each of the engaging protuberant parts 23 in this order from the forward side to the backward side of an opening direction of the outer cap 20 (the direction indicated by arrow K in FIG. 8(B)). Front and rear side surfaces of each of the engaging protuberant parts 23 are vertical parts 23*d* and 23*c*, respectively. The pairs of engaging protuberant parts 13 and engaging protuberant parts 23 of FIGS. 7 and 8 work in an identical manner to the pairs of engaging protuberant parts 13 and engaging protuberant parts 23 of FIGS. 1 to 5, and exert a child-resistant function. One of or both of the vertical part 13*d* of FIG. 8(A) and the vertical part 23*d* of FIG. 8(B) may be eliminated. In this case, the lower end of the steeply inclined part 13*b* may be fitted to the upper surface of the ceiling part 12*a* or the upper end of the gently inclined part 23*b*1 may be fitted to the lower surface of the ceiling part 22.

In the above description, each of the inner cap 10 and the outer cap 20 can be integrally formed from a proper rigid plastic material.

The present application claims the benefit of the priority date of Japanese patent application No. 2012-129510 filed on Jun. 7, 2012. All of the contents of the Japanese patent application No. 2012-129510 filed on Jun. 7, 2012, are incorporated herein by reference.

The safety cap of the present invention is suitably widely applicable as a safety cap of a container for any purpose that requires a child-resistant function.

DESCRIPTION OF THE REFERENCE NUMERALS

10 inner cap
20 outer cap
13, 23 engaging protuberant part
13*b*, 23*b* steeply inclined part
13*b*1, 23*b*1 gently inclined part
13*c*, 23*c* vertical part

The invention claimed is:

1. A safety cap comprising:

a screw-type inner cap detachably mounted on a mouth of a container; and an outer cap that is combined with the inner cap so as to be rotatable relative to the inner cap, each of the inner cap and the outer cap having a plurality of engaging protuberances, the engaging protuberances of the inner cap and the engaging protuberances of the outer cap being engaged with each other and rotating the inner cap when the outer cap is rotated while being pressed toward the inner cap, each of the engaging protuberances having a vertical part that is engaged when the outer cap is rotated in a closing direction and an inclined part that is engaged when the outer cap is rotated in an opening direction, and the inclined part having a steeply inclined part that has a steep inclination and a gently inclined part that has a gentler inclination than the steeply inclined part, the steeply inclined part and the gently inclined part being continuous with each other, wherein the inclined part has a convex inclined part that is formed into a convex shape by the steeply inclined part and the gently inclined part in one of the engaging protuberances of the inner cap and the engaging protuberances of the outer cap, and a concave inclined part that is formed into a concave shape by the steeply inclined part and the gently inclined part in the other of the engaging protuberances of the inner cap and the engaging protuberances of the outer cap, and wherein the convex inclined part and the concave inclined part are engageable in close contact with each other.

2. The safety cap according to claim 1, wherein the steeply inclined part has a longer length in a circumferential direction than the gently inclined part.

* * * * *